US008651402B2

(12) United States Patent
Munn et al.

(10) Patent No.: US 8,651,402 B2
(45) Date of Patent: Feb. 18, 2014

(54) ADJUSTABLE NOZZLE TIP FOR PAINT SPRAYER

(75) Inventors: Jamie S. Munn, Maitland (CA); Graeme Crawley, Newcastle upon Tyne (GB); Steven R. Wiezorek, Baltimore, MD (US); SuHu Zhou, Jinhua (CN); GenZhang Ye, Jinhua (CN)

(73) Assignee: Black & Decker Inc., Newark, DE (US)

( * ) Notice: Subject to any disclaimer, the term of this patent is extended or adjusted under 35 U.S.C. 154(b) by 602 days.

(21) Appl. No.: 12/898,497

(22) Filed: Oct. 5, 2010

(65) Prior Publication Data

US 2011/0114756 A1 May 19, 2011

Related U.S. Application Data

(60) Provisional application No. 61/261,953, filed on Nov. 17, 2009.

(51) Int. Cl.
*B05B 1/00* (2006.01)
*B05B 1/28* (2006.01)
*B05B 15/04* (2006.01)

(52) U.S. Cl.
USPC ..... 239/600; 239/288; 239/288.3; 239/288.5; 239/DIG. 14

(58) Field of Classification Search
USPC ..... 239/288, 288.3, 288.5, 329, 600, 239/DIG. 14
See application file for complete search history.

(56) References Cited

U.S. PATENT DOCUMENTS 1,799,143 A 4/1931 Bailey
1,807,490 A 5/1931 Milner
1,919,233 A 7/1933 Lee
2,098,014 A 11/1937 Polston
2,105,681 A 1/1938 Armstrong (Continued)

FOREIGN PATENT DOCUMENTS

CN 1150396 A 5/1997
CN 1640561 A 7/2005

(Continued)

OTHER PUBLICATIONS

PCT International Search Report and Written Opinion for International Appln. No. PCT/US2010/057042 dated Apr. 21, 2011, 12 pages.

(Continued)

*Primary Examiner* — Ryan Reis
(74) *Attorney, Agent, or Firm* — Harness, Dickey & Pierce, P.L.C.

(57) ABSTRACT

A sprayer that dispenses paint stored in a reservoir body generally includes a housing and a channel member having an outer periphery with a threaded portion and an inner periphery defining an aperture. The channel member extends from the housing. A spray nozzle is connected to the inner periphery in the channel member. A collar member has an inner periphery with a threaded portion that is operable to engage to the threaded portion on the outer periphery of the channel member. A guard member is rotatably engaged with the spray nozzle and movable between an extended condition and a retracted condition. The guard member in the retracted condition is engaged for rotation with the collar member and is operable rotate the threaded portion of the collar member over the threaded portion of the channel member. The guard member in the extended condition is rotatable relative to the collar member.

15 Claims, 6 Drawing Sheets

(56) References Cited

U.S. PATENT DOCUMENTS

| | | | | |
|---|---|---|---|---|
| 2,455,240 | A | 11/1948 | Dupler | |
| 2,456,493 | A | 12/1948 | Drane et al. | |
| 2,540,357 | A | 2/1951 | Stanley | |
| 2,888,207 | A | 5/1959 | Sykes | |
| 3,191,869 | A | 6/1965 | Gilmour | |
| 3,428,291 | A | 2/1969 | Callahan, Jr. et al. | |
| 3,795,366 | A | 3/1974 | McGhie et al. | |
| 3,816,165 | A | 6/1974 | Horvath et al. | |
| RE29,055 | E | 11/1976 | Wagner | |
| 4,106,181 | A | 8/1978 | Mattchen | |
| 4,116,386 | A * | 9/1978 | Calder | 239/119 |
| 4,137,952 | A | 2/1979 | Rendemonti | |
| 4,228,957 | A | 10/1980 | Davini | |
| 4,245,784 | A | 1/1981 | Garcin | |
| 4,278,205 | A | 7/1981 | Binoche | |
| 4,349,947 | A | 9/1982 | Rood | |
| 4,365,745 | A | 12/1982 | Beck | |
| 4,433,799 | A | 2/1984 | Corsette | |
| 4,442,977 | A | 4/1984 | Beiswenger et al. | |
| 4,483,483 | A | 11/1984 | Grime | |
| 4,501,500 | A | 2/1985 | Terrels | |
| 4,537,357 | A | 8/1985 | Culbertson et al. | |
| 4,551,037 | A | 11/1985 | Kille et al. | |
| 4,569,366 | A | 2/1986 | West et al. | |
| 4,569,503 | A | 2/1986 | Karr, Jr. | |
| 4,687,140 | A * | 8/1987 | Hasegawa | 239/332 |
| 4,692,049 | A | 9/1987 | Engle | |
| 4,693,423 | A | 9/1987 | Roe et al. | |
| 4,735,362 | A | 4/1988 | Trautwein et al. | |
| 4,804,144 | A | 2/1989 | Denman | |
| 4,811,904 | A | 3/1989 | Ihmels et al. | |
| 4,884,742 | A * | 12/1989 | Bekius et al. | 239/71 |
| 4,936,511 | A | 6/1990 | Johnson et al. | |
| 4,971,251 | A | 11/1990 | Dobrick et al. | |
| 4,993,596 | A | 2/1991 | Brown | |
| 5,009,367 | A | 4/1991 | Nielsen | |
| 5,033,552 | A | 7/1991 | Hu | |
| 5,056,717 | A | 10/1991 | Koide | |
| 5,057,342 | A | 10/1991 | Hoy et al. | |
| 5,060,869 | A * | 10/1991 | Bekius | 239/599 |
| 5,090,623 | A | 2/1992 | Burns et al. | |
| 5,119,992 | A | 6/1992 | Grime | |
| 5,141,156 | A | 8/1992 | Hoy et al. | |
| 5,217,168 | A | 6/1993 | Svendsen | |
| 5,281,782 | A | 1/1994 | Conatser | |
| 5,284,299 | A | 2/1994 | Medlock | |
| 5,395,051 | A | 3/1995 | Anderson et al. | |
| 5,609,302 | A | 3/1997 | Smith | |
| 5,630,552 | A | 5/1997 | Anfindsen et al. | |
| 5,687,913 | A | 11/1997 | Robisch et al. | |
| 5,706,856 | A | 1/1998 | Lancaster | |
| 5,779,157 | A | 7/1998 | Robisch et al. | |
| 5,803,367 | A | 9/1998 | Heard et al. | |
| 5,826,795 | A | 10/1998 | Holland et al. | |
| 5,836,517 | A | 11/1998 | Burns et al. | |
| 5,927,602 | A | 7/1999 | Robisch et al. | |
| 5,934,887 | A | 8/1999 | Veit | |
| 5,949,209 | A | 9/1999 | Okamoto et al. | |
| 5,992,690 | A | 11/1999 | Tracy | |
| 6,000,419 | A | 12/1999 | Bernhard | |
| 6,009,899 | A | 1/2000 | Polutnik | |
| 6,089,471 | A | 7/2000 | Scholl | |
| 6,106,742 | A | 8/2000 | Argyropoulos et al. | |
| 6,189,804 | B1 | 2/2001 | Vetter et al. | |
| 6,247,995 | B1 | 6/2001 | Bryan | |
| 6,263,980 | B1 | 7/2001 | Wadge | |
| 6,286,611 | B1 | 9/2001 | Bone | |
| 6,383,062 | B1 | 5/2002 | Jou | |
| 6,390,386 | B2 | 5/2002 | Krohn et al. | |
| 6,431,466 | B1 | 8/2002 | Kitajima | |
| 6,527,200 | B1 | 3/2003 | Huang | |
| 6,547,161 | B1 | 4/2003 | Huang | |
| 6,553,642 | B2 | 4/2003 | Driessen | |
| 6,623,561 | B2 | 9/2003 | Vetter et al. | |
| 6,631,855 | B2 | 10/2003 | Huang | |
| 6,675,911 | B2 | 1/2004 | Driessen | |
| 6,702,203 | B2 | 3/2004 | Jou | |
| 6,805,306 | B1 | 10/2004 | Huang | |
| 6,824,075 | B2 | 11/2004 | Zimmermann | |
| 6,874,702 | B2 | 4/2005 | Turnbull | |
| 6,971,590 | B2 | 12/2005 | Blette et al. | |
| 7,017,835 | B2 | 3/2006 | Vetter et al. | |
| 7,021,399 | B2 | 4/2006 | Driessen | |
| 7,032,839 | B2 | 4/2006 | Blette et al. | |
| 7,069,948 | B2 | 7/2006 | Lovell | |
| 7,121,299 | B2 | 10/2006 | Lumello | |
| 7,128,283 | B1 * | 10/2006 | Shahin | 239/600 |
| 7,185,672 | B2 | 3/2007 | Lovell | |
| 7,201,336 | B2 | 4/2007 | Blette et al. | |
| 7,207,497 | B2 | 4/2007 | Clark | |
| 7,246,759 | B2 | 7/2007 | Turnbull | |
| 7,250,023 | B2 | 7/2007 | Bai | |
| 7,347,136 | B2 | 3/2008 | Bruggeman et al. | |
| 7,360,720 | B2 | 4/2008 | Gohring et al. | |
| 7,374,377 | B2 | 5/2008 | Bauman | |
| 7,431,223 | B2 | 10/2008 | Gohring | |
| 7,484,676 | B2 | 2/2009 | Joseph et al. | |
| 7,540,434 | B2 | 6/2009 | Gohring et al. | |
| 7,549,449 | B2 | 6/2009 | Herre et al. | |
| 2002/0166905 | A1 | 11/2002 | Huang | |
| 2003/0201340 | A1 | 10/2003 | Hanson | |
| 2004/0164182 | A1 | 8/2004 | Joseph et al. | |
| 2005/0150521 | A1 | 7/2005 | Jones et al. | |
| 2005/0269425 | A1 | 12/2005 | Gohring et al. | |
| 2005/0279517 | A1 | 12/2005 | Hoffman et al. | |
| 2006/0005766 | A1 | 1/2006 | Gorges et al. | |
| 2006/0275555 | A1 | 12/2006 | Colizza | |
| 2007/0278787 | A1 | 12/2007 | Jones et al. | |
| 2008/0029619 | A1 | 2/2008 | Gohring et al. | |
| 2008/0217442 | A1 | 9/2008 | Anfindsen et al. | |
| 2008/0226407 | A1 | 9/2008 | Bauman | |
| 2008/0296409 | A1 | 12/2008 | Micheli | |
| 2009/0145980 | A1 * | 6/2009 | Jones | 239/215 |
| 2009/0230218 | A1 | 9/2009 | Drozd | |
| 2009/0277976 | A1 | 11/2009 | Micheli et al. | |
| 2009/0302133 | A1 | 12/2009 | Micheli et al. | |
| 2010/0163654 | A1 | 7/2010 | Bass et al. | |

FOREIGN PATENT DOCUMENTS

| | | | |
|---|---|---|---|
| CN | 1706557 | A | 12/2005 |
| CN | 101081383 | A | 12/2007 |
| CN | 101125317 | A | 2/2008 |
| DE | 8713954 | U1 | 12/1987 |
| DE | 202007003070 | U1 | 7/2008 |
| DE | 202008009203 | U1 | 9/2008 |
| EP | 0513626 | A1 | 11/1992 |
| GB | 290866 | A | 5/1928 |
| GB | 2063424 | A | 6/1981 |
| JP | 63-020965 | U | 2/1988 |
| JP | 5212323 | A | 8/1993 |
| JP | 10507249 | T | 7/1998 |
| JP | 10510209 | T | 10/1998 |
| JP | 2003088781 | A | 3/2003 |
| WO | WO-9617689 | A1 | 6/1996 |
| WO | WO-9809073 | A1 | 3/1998 |
| WO | 02072276 | A1 | 9/2002 |
| WO | WO-2004025123 | A1 | 3/2004 |
| WO | WO-2006087055 | A1 | 8/2006 |
| WO | WO-2010047800 | A2 | 4/2010 |

OTHER PUBLICATIONS

PCT International Search Report and Written Opinion for International Appln. No. PCT/US2010/057033 dated Mar. 17, 2011, 8 pages.

PCT International Search Report and Written Opinion for International Appln. No. PCT/US2010/057041 dated Mar. 17, 2011, 10 pages.

PCT International Search Report and Written Opinion for International Appln. No. PCT/US2010/057050 dated Mar. 14, 2011, 8 pages.

* cited by examiner

ADJUSTABLE NOZZLE TIP FOR PAINT SPRAYER

CROSS-REFERENCE TO RELATED APPLICATIONS

This application claims the benefit of U.S. Provisional Application No. 61/261,953, filed on Nov. 17, 2009. The entire disclosure of the above application is incorporated herein by reference.

FIELD

The present disclosure relates to an adjustable nozzle tip for a paint sprayer and more specifically relates to a guard member of the adjustable nozzle tip that can be rotated without disturbing a threaded connection.

BACKGROUND

This section provides background information related to the present disclosure which is not necessarily prior art.

Typically, the pattern of a paint sprayer is adjusted by rotating the spray nozzle. In this arrangement, however, rotation of the spray nozzle has a propensity of loosening the spray nozzle from the reservoir that contains the paint.

SUMMARY

This section provides a general summary of the disclosure, and is not a comprehensive disclosure of its full scope or all of its features.

The present teachings generally include a sprayer that dispenses paint stored in a reservoir body. The sprayer generally includes a housing and a channel member having an outer periphery with a threaded portion and an inner periphery defining an aperture. The channel member extends from the housing. A spray nozzle is connected to the inner periphery in the channel member. A collar member has an inner periphery with a threaded portion that is operable to engage to the threaded portion on the outer periphery of the channel member. A guard member is rotatably engaged with the spray nozzle and movable between an extended condition and a retracted condition. The guard member in the retracted condition is engaged for rotation with the collar member and is operable to rotate the threaded portion of the collar member over the threaded portion of the channel member. The guard member in the extended condition is rotatable relative to the collar member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
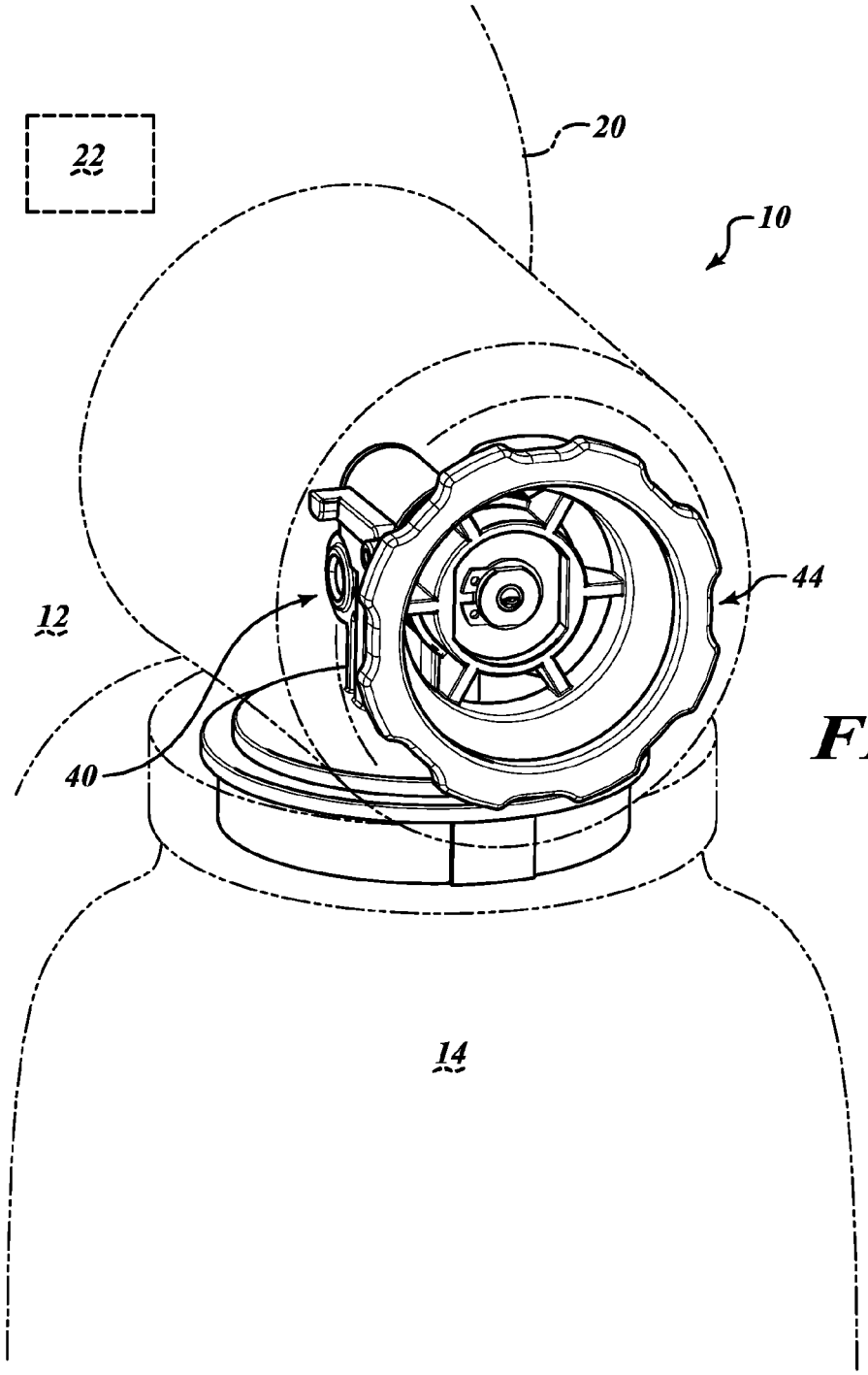
FIG. 1 is a simplified perspective view of a paint sprayer constructed in accordance with the present teachings.

With reference to FIG. 1 of the drawings, a first sprayer constructed in accordance with the teachings of the present disclosure is generally indicated by reference numeral 10. The sprayer 10 can include a sprayer body 12 and a reservoir body 14 that can be removably coupled to the sprayer body 12. The sprayer body 12 can include a housing 20 with a solenoid motor 22. The housing 20 can be formed of one or more housing components, such as a pair of clam shell housing halves. The solenoid motor 22 can be contained in the housing 20 and can employed to draw a liquid, such as a paint or a stain, from the reservoir body 14.

Figure 2:
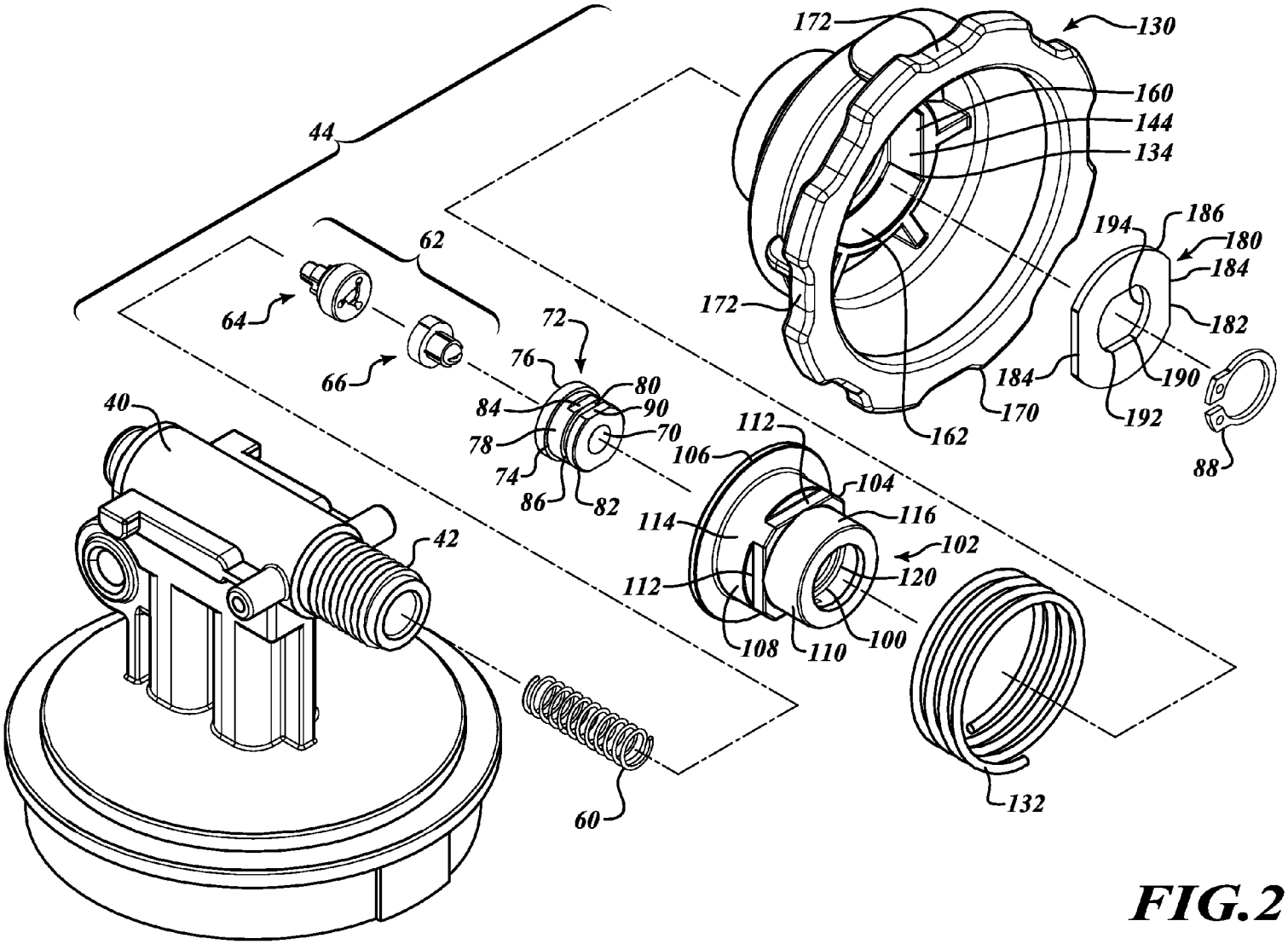
FIG. 2 is an exploded assembly view of a spray nozzle assembly of the sprayer of FIG. 1 constructed in accordance with the present teachings.
Figure 3:
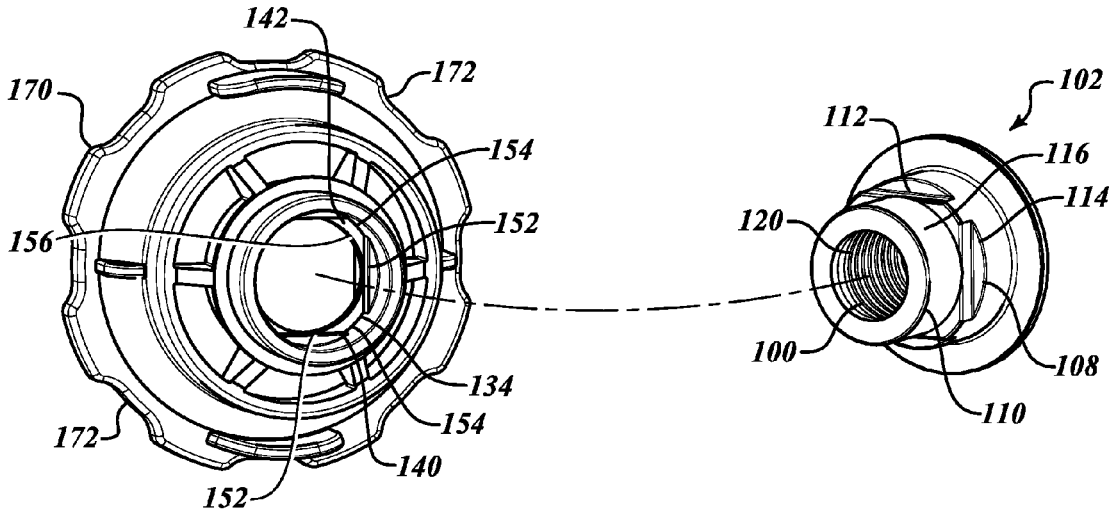
FIG. 3 is a partial exploded assembly view of a guard member and a collar member in accordance with the present teachings.
Figure 4:
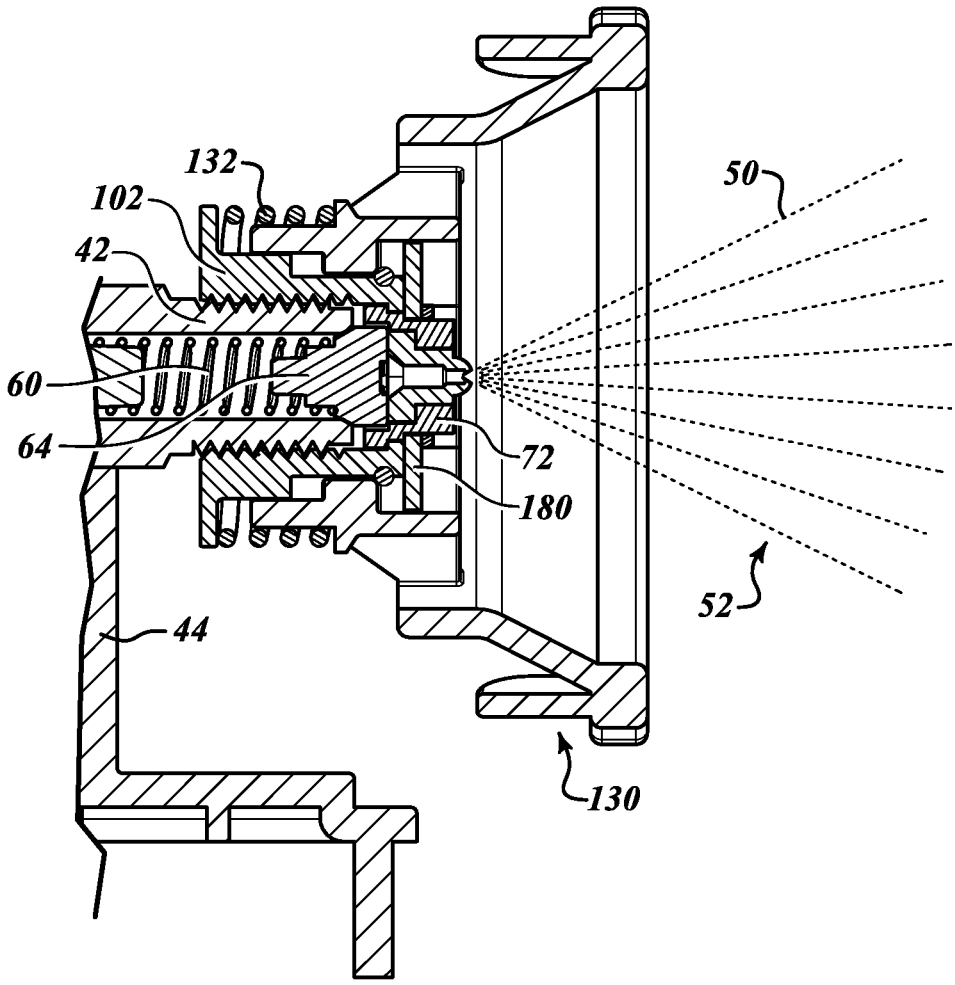
FIG. 4 is a diagram of a partial cross-section showing the guard member, the collar member, and a channel member that leads to a reservoir that holds the paint for the paint sprayer constructed in accordance with the present teachings.
Figure 5:
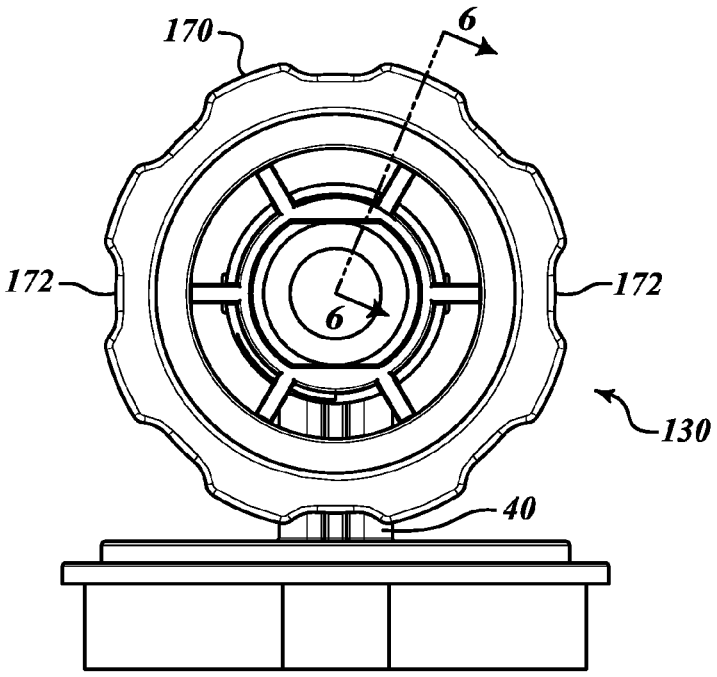
FIG. 5 is a front view of the spray nozzle assembly constructed in accordance with the present teachings.

With reference to FIGS. 2, 3, and 4, the housing 20 of the sprayer 10 can have a channel member 40 that can extend from the housing 20 and also connect to the reservoir body. The channel member 40 can have a threaded portion 42, in this example a threaded collar, to which a spray nozzle assembly 44 can attach. The spray nozzle assembly 44 can receive the paint from the reservoir body 14 and deliver a spray 50 of the paint in a pattern 52. From the threaded portion 42 on the channel member 40, a spring member 60 can extend and contact a spray nozzle 62. The spray nozzle 62 can include an atomizer head portion 64 that can turn the flow of the paint into a cloud of droplets. The spray nozzle 62 can also include an orifice portion 66 that can impart the pattern 52 on the cloud of droplets to produce the spray 50 with the pattern 52. In one example, the orifice portion 66 can be made of ceramic.

The spray nozzle 62 can be secured to the spring member 60 that is found inside the channel member 40 to bias the atomizer head portion 64 against the orifice portion 66. The spray nozzle 62 can be seated in an inner periphery 70 of and engaged for rotation with a nozzle carrier 72. The nozzle carrier 72 has an outer periphery 74. The outer periphery 74 can have a flange 76, a first peripheral zone 78, and a second peripheral zone 80, and a third peripheral zone 82. The first peripheral zone 78 can include a flat surface 84. In one example, the first peripheral zone 78 can include multiple flat surfaces 84 equally spaced from one another. The second peripheral zone 80 can include an annular groove 86 that can accept a fastener 88. In this example, the fastener 88 is a snap-ring. The third peripheral zone 82 can also include flat surfaces 90 that can be similarly configured to the flat surfaces 84.

The outer periphery 74 of the nozzle carrier 72 can be seated in an inner periphery 100 of a collar member 102. The nozzle carrier 72 can rotate relative to the collar member 102. The collar member 102 has an outer periphery 104 that includes a flange 106, a first peripheral zone 108, and a second peripheral zone 110. The first peripheral zone 108 can include a flat surface 112. In this example, the first peripheral zone 108 can include four flat surfaces 112 equally spaced from one another. The flat surfaces 112 can interrupt a circular contour 114. The second peripheral zone 110 can include an uninterrupted circular contour 116. The collar member 102 has an inner periphery 100 that can include a threaded portion 120. The threaded portion 120 on the inner periphery 100 of the collar member 104 can threadably engage the threaded portion 42 of the channel member 40 to connect the spray nozzle assembly 44 to the housing 20 of the sprayer 10.

The collar member 102 can fit into a guard member 130 and hold an elastic member 132, which is shown as a spring, between the guard member 130 and the collar member 102. The guard member 130 has an inner periphery 134. The inner periphery 134 includes a first peripheral zone 140, a second peripheral zone 142, and a third peripheral zone 144. The first peripheral zone 140 includes a protrusion 150 that can interrupt a circular contour 152. In this example, the inner periphery 134 of the guard member 130 can include four protrusions 150 that can interrupt the circular contour 152. The four protrusions 150 can be configured to interact with the four flat surfaces 112 on the collar member 102.

The second peripheral zone 142 can be configured with a reduced diameter portion 154 that can have an uninterrupted circular contour 156. The reduced diameter portion 154 of the inner periphery 134 can rotatably receive the second peripheral zone 110 of the outer periphery 104 on the collar member 102. The third peripheral zone 144 can have a flat surface 160 that can interrupt a circular contour 162. In this example, the third peripheral zone 144 can have two flat surfaces 160 that interrupt the circular contour 162.

The guard member 130 has an outer periphery 170. The outer periphery 170 has multiple finger depressions 172 that can be operable to assist the user in rotating the guard member 130. The elastic member 132 can be seated against the reduced diameter portion 154 of the second peripheral zone 142 in the guard member 130 and the flange 106 on the collar member 102.

A connection member 180 can have an outer periphery 182. The outer periphery 182 can have a flat surface 184 that can interrupt a circular contour 186. In this example, the outer periphery 182 can have two flat surfaces 184 that interrupt the circular contour 186 and are equally spaced from one another. The flat surfaces 184 can interact with the flat surfaces 160 in the third peripheral zone 144 on the guard member 130. The connection member 180 can have an inner periphery 190 that can have a flat surface 192 that interrupts a circular contour 194. There can be two flat surfaces 192 that interrupt the circular contour 194 and interact with the flat surfaces 84 on the nozzle carrier 72.

The nozzle carrier 72, when seated in the collar member 102, can extend (at least partially) from the collar member 102 so that the connection member 18 can be placed over the second peripheral zone 80 of the nozzle carrier 72. In this arrangement, the fastener 88 can be inserted into the annular groove 86 formed in the nozzle carrier 72 to lock the connection member 180 in the first peripheral zone 78. The nozzle carrier 72 is then secured to the connection member 180 and the spray nozzle assembly 44 is assembled to the housing 20 of the sprayer 10.

Figure 6:
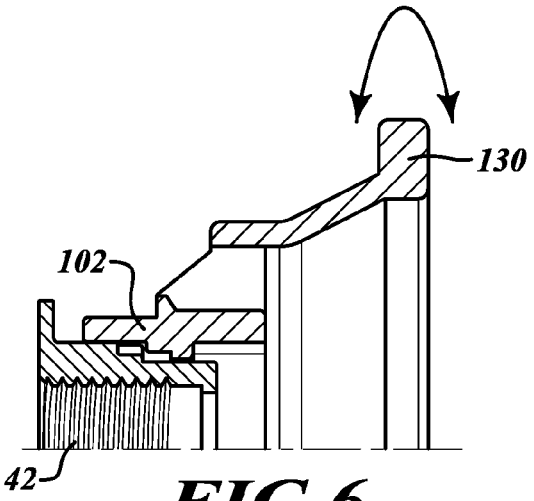
FIG. 6 is a diagram of a partial cross-section of FIG. 5 showing the guard member in an extended condition and rotation of the guard member relative to the collar member in accordance with the present teachings.
Figure 7:
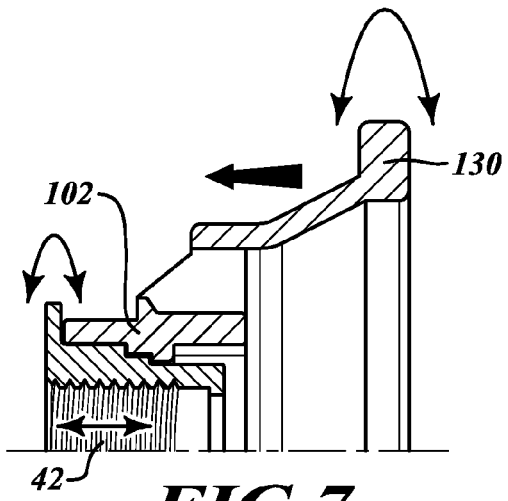
FIG. 7 is a diagram of a partial cross-section of FIG. 5 showing the guard member in a retracted condition rotationally engaged to the collar member so as to drive the collar member over threaded portions on the channel member in accordance with the present teachings.

In operation, the guard member 130 can be moved between an extended condition (FIG. 6) and a retracted condition (FIG. 7). In the extended condition, the guard member 130 is free to rotate relative to the collar member 102. In the retracted condition, when the guard member 130 is pushed closer to the channel member 40, the guard member 130 is engaged for rotation with the collar member 102. When the collar member 102 is engaged for rotation with the guard member 130, the user can grasp the guard member 130, push it into the retracted condition, and can thread the collar member 102 over the threaded portion 42 on the channel member 40 to secure it to the spray nozzle assembly 44. Without disturbing the threaded connection between the collar member 102 and the channel member 40, the user can rotate the guard member 130 and orient the pattern 52 of the spray 50 by rotating the guard member 130. The guard member 130 can be rotated to any point along 360 degrees of rotation without disturbing the threaded connection between the collar member 102 and the channel member 40.

Figure 8:
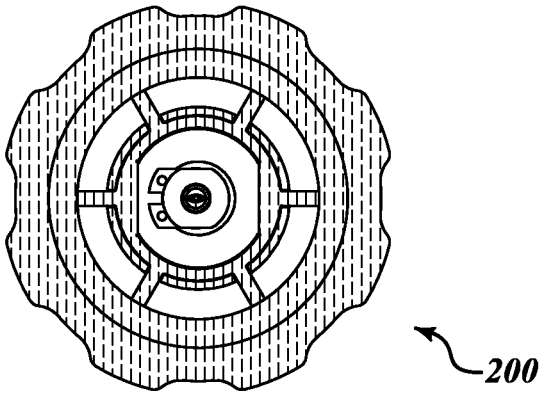
FIG. 8 is a simplified front view of a spray nozzle assembly having a spray pattern and a guard member with a specific color indication in accordance with the present teachings.
Figure 9:
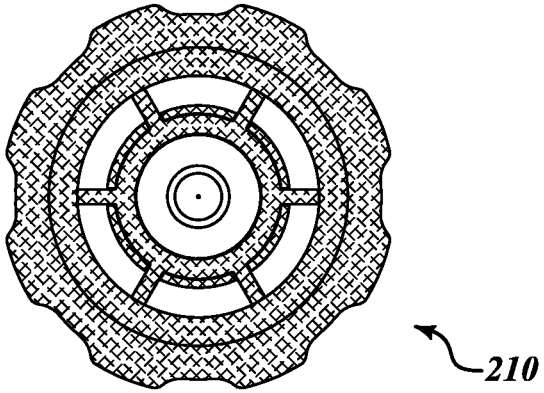
FIG. 9 is a front view of another spray nozzle assembly having a different spray pattern and a guard member with a different color indication relative to FIG. 8 in accordance with the present teachings.

With reference to FIGS. 8 and 9, a spray nozzle assembly 200 can be shown where the spray nozzle assembly 200 is provided in a specific color. In this instance, the spray nozzle assembly 200 is supplied in a blue color that is indicative of a spray pattern out of the spray nozzle assembly 200 having a flat planar shape. In another example, a spray nozzle assembly 210 can be provided with a different orange color that can be indicative of a different spray pattern. The pattern of the spray from the spray nozzle assembly 210 provided in green can be a fully symmetrical cone spray. It will be appreciated in light of the disclosure that multiple spray nozzle assemblies can be included with varied and different colors to indicate respective spray patterns.

The foregoing description of the many aspects of the present teachings have been provided for purposes of illustration and description. It is not intended to be exhaustive or to limit the teachings. Individual elements or features of particular aspects are generally not limited to that particular aspect, but, where applicable, are interchangeable and can be used in selected aspects, even if not specifically shown or described. The same may also be varied in many ways. Such variations are not to be regarded as a departure from the teachings, and all such modifications are intended to be included within the scope of the disclosure.

The terminology used herein is for the purpose of describing particular example embodiments only and is not intended to be limiting. As used herein, the singular forms "a", "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to," or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A sprayer that dispenses paint stored in a reservoir body, the sprayer comprising:

a housing;

a channel member having a threaded portion and defining an aperture, said channel member coupled to and extending from said housing;

a collar member having a mating threaded portion threadably coupled to said threaded portion of said channel member;

a spray nozzle received in said collar member and in fluid communication with said aperture in said channel member, said spray nozzle being rotatable relative to said collar member about a rotational axis; and a guard member coupled to said spray nozzle for rotation therewith, said guard member being movable along the rotational axis between an extended condition and a retracted condition, wherein when said guard member is in said retracted condition, said guard member is engaged for rotation with said collar member to thereby non-rotatably couple the spray nozzle to said channel member, and wherein when said guard member is in said extended condition, said guard member is rotatable relative to said collar member to thereby permit rotation of said spray nozzle relative to said channel member.

2. The sprayer of claim 1, wherein said spray nozzle includes an atomizer portion and an orifice portion that is operable to impart a pattern on a spray of the paint from said spray nozzle, said guard member is rotatable to rotate said pattern.

3. The sprayer of claim 2, wherein said atomizer portion is rotatable relative to said orifice portion.

4. The sprayer of claim 1, wherein said guard member has color that is indicative of a pattern of a spray from said spray nozzle.

5. A sprayer that dispenses paint from a reservoir body, the sprayer comprising:

a housing having a solenoid piston pump;

a channel member connected to said solenoid piston pump, said channel member having an outer periphery with a threaded portion and inner periphery defining an aperture;

a spray nozzle;

a nozzle carrier having an inner periphery and an outer periphery, said inner periphery holds said spray nozzle, said nozzle carrier and said spray nozzle connect to said channel member to direct the paint from the reservoir body to said spray nozzle;

a collar member having an inner periphery and an outer periphery, said nozzle carrier disposed in said inner periphery of said collar member and rotatable relative to said collar member, said outer periphery of said collar member having a flange, said inner of said collar member periphery having a threaded portion operable to engage to said threaded portion on said outer periphery of said channel member;

a guard member having an inner periphery and an outer periphery, said outer periphery of said collar member disposed in said inner periphery of said guard member;

an elastic member disposed between a surface on said inner periphery of said guard member and said flange on said collar member, said elastic member operable to urge said guard member to an extended condition from a retracted condition; and a connection member having an inner periphery and an outer periphery, said outer periphery of said connection member is engaged for rotation with said guard member, said inner periphery of said connection member is fixed for rotation with said nozzle carrier, said guard member in said extended condition is rotatable relative to said collar member, said guard member in said retracted condition is engaged for rotation with said collar member and is operable to rotate said threaded portion of said collar member over said threaded portion of said channel member.

6. The sprayer of claim 5, wherein said spray nozzle includes an atomizer portion and an orifice portion that is operable to impart a pattern on a spray of the paint from said spray nozzle.

7. The sprayer of claim 6, wherein said atomizer portion is rotatable relative to said orifice portion.

8. The sprayer of claim 5, wherein said outer periphery of said collar member includes a first peripheral zone disposed between said flange and a second peripheral zone, said first peripheral zone having a flat surface that interrupts a circular contour.

9. The sprayer of claim 5, wherein said first peripheral zone includes multiple flat surfaces that interrupt said circular contour and are equally spaced from one another.

10. The sprayer of claim 5, wherein said inner periphery of said guard member includes a first peripheral zone, a second peripheral zone, and a third peripheral zone, said third peripheral zone having a flat surface that interrupts a circular contour, said second peripheral zone having an uninterrupted circular contour and a reduced diameter portion relative to said first and third peripheral zones, said second peripheral zone of said guard member holds said outer periphery of said collar member, said first peripheral zone of said guard member having a protrusion that interrupts a circular contour.

11. The sprayer of claim 10, wherein said third peripheral zone of said guard member includes multiple flat surfaces that interrupt said circular contour and are equally spaced from one another.

12. The sprayer of claim 10, wherein said first peripheral zone of said guard member includes multiple protrusions that interrupt said circular contour and are equally spaced from one another.

13. A sprayer that dispenses paint stored in a reservoir body, the sprayer comprising:

a housing;

a channel member having an outer periphery with a threaded portion and an inner periphery defining an aperture, said channel member extends from said housing;

a first spray nozzle connected to said inner periphery in said channel member, said first spray nozzle is operable to produce a first pattern of a spray of the paint;

a first collar member having an inner periphery with a threaded portion operable to engage to said threaded portion on said outer periphery of said channel member; and a first guard member rotatably engaged with said first spray nozzle and movable between an extended condition and a retracted condition, said first guard member in said retracted condition is engaged for rotation with said first collar member and is operable to rotate said threaded portion of said first collar member over said threaded portion of said channel member, said first guard member in said extended condition is rotatable relative to said first collar member and coaxially with said threaded portion of said first collar member, said first guard member has a first color that is indicative of said pattern of said spray from said first spray nozzle, said first guard member is rotatable to rotate said pattern.

14. The sprayer of claim 13 further comprising:

a second spray nozzle operable to connect to said inner periphery in said channel member, said second spray nozzle is operable to produce a second pattern of a spray of the paint different from said first pattern;

a second collar member having an inner periphery with a threaded portion operable to engage to said threaded portion on said outer periphery of said channel member; and a second guard member rotatably engaged with said second spray nozzle and said second collar member, said second guard member has a second color that is indicative of said second pattern of said spray from said second spray nozzle, said second color is different from said first color.

15. The sprayer of claim 14 further comprising:

a third spray nozzle operable to connect to said inner periphery in said channel member, said third spray nozzle is operable to produce a third pattern of a spray of the paint different from said first pattern and said second pattern;

a third collar member having an inner periphery with a threaded portion operable to engage to said threaded portion on said outer periphery of said channel member; and a third guard member rotatably engaged with said third spray nozzle and movable between an extended condition and a retracted condition, said third guard member in said retracted condition is engaged for rotation with said third collar member and is operable to rotate said threaded portion of said third collar member over said threaded portion of said channel member, said third guard member in said extended condition is rotatable relative to said third collar member, said third guard member has a third color that is indicative of said third pattern of said spray from said third spray nozzle, said third guard member is rotatable to rotate said third pattern, said third pattern is different from said first pattern and said second pattern.

* * * * *